US010070770B2

(12) United States Patent
Butts

(10) Patent No.: US 10,070,770 B2
(45) **Date of Patent: *Sep. 11, 2018**

(54) LINT ROLLER WITH SECURED AGITATOR ARM

(71) Applicant: Butler Home Products, LLC, Marlborough, MA (US)

(72) Inventor: Mark Butts, Atlanta, GA (US)

(73) Assignee: Butler Home Products LLC, Hudson, MA (US)

( * ) Notice: Subject to any disclaimer, the term of this patent is extended or adjusted under 35 U.S.C. 154(b) by 34 days.

This patent is subject to a terminal disclaimer.

(21) Appl. No.: 15/174,599

(22) Filed: Jun. 6, 2016

(65) Prior Publication Data

US 2016/0278610 A1 Sep. 29, 2016

Related U.S. Application Data

(63) Continuation of application No. 13/585,629, filed on Aug. 14, 2012, now Pat. No. 9,375,131.

(60) Provisional application No. 61/523,725, filed on Aug. 15, 2011.

(51) Int. Cl.

| | |
|---|---|
| ***A47L 25/00*** | (2006.01) |
| ***B08B 7/00*** | (2006.01) |
| ***A47L 25/08*** | (2006.01) |
| ***B08B 7/04*** | (2006.01) |

(52) U.S. Cl.

CPC ..... *A47L 25/005* (2013.01); *A47L 25/08* (2013.01); *B08B 7/04* (2013.01); *B08B 7/0028* (2013.01)

(58) Field of Classification Search

CPC ..... A47L 25/005; B08B 7/04; B08B 7/0028

USPC ..... 15/104.002, 230.11; 492/13, 16–17, 19

See application file for complete search history.

(56) References Cited

U.S. PATENT DOCUMENTS

| | | | | |
|---|---|---|---|---|
| 2,624,060 | A | 1/1953 | McKenzie | |
| 4,422,201 | A * | 12/1983 | McKay | A47L 25/005 15/104.002 |
| 4,627,126 | A | 12/1986 | Nichols | |
| 6,735,806 | B2 | 5/2004 | Blum et al. | |
| 6,925,674 | B2 | 8/2005 | Prince et al. | |
| 7,039,982 | B1 | 5/2006 | McKay | |
| 7,856,690 | B2 | 12/2010 | Tuman et al. | |
| 9,375,131 | B2 * | 6/2016 | Butts | A47L 25/005 |
| 2002/0194691 | A1 | 12/2002 | Meyer | |
| 2003/0233721 | A1 | 12/2003 | Prince et al. | |
| 2005/0184099 | A1 | 8/2005 | McKay | |
| 2007/0163062 | A1 | 7/2007 | McKay | |
| 2011/0078866 | A1 | 4/2011 | Panthofer et al. | |
| 2012/0284939 | A1 | 11/2012 | Anderson | |

* cited by examiner

*Primary Examiner* — Laura C Guidotti

(74) *Attorney, Agent, or Firm* — McCarter & English, LLP

(57) ABSTRACT

A cleaning apparatus configured for removing debris or lint from clothing by agitating lint and then rolling it off. The cleaning apparatus includes a handle with a first end and a second end, a cleaning roll support extending from the handle second end and terminating at a distal end, an agitator arm extending from the handle second end parallel to the cleaning roll support and terminating at a distal end and an end cap rotatably connected to the agitator arm distal end. The end cap is configured to be rotatable between an open position away from the cleaning roll support and a closed position in which the end cap engages with the distal end of the cleaning roll support.

11 Claims, 12 Drawing Sheets

LINT ROLLER WITH SECURED AGITATOR ARM

CROSS REFERENCE TO RELATED CASES

This application claims priority under 35 U.S.C. § 120 to U.S. patent application Ser. No. 13/585,629 filed on Aug. 14, 2012, which claims priority under 35 U.S.C. § 119(e) to U.S. Provisional Application No. 61/523,725 filed on Aug. 15, 2011, the contents of each of which are hereby incorporated in their entirety.

FIELD

The field of this invention is personal care products and specifically to lint removal devices.

BACKGROUND

The field of lint removal devices has seen various embodiments from hand formed folds of tape to bristle brushes. Conventional lint rollers include a handle, a tape roll support extending from the handle, and a roll of tape rotatably mounted on the support. The user rolls the tape (having an adhesive side facing outwardly) over the surface to be cleaned, and debris (e.g. lint, hair, etc.) is adhered to the tape thus lifting it off of the surface being cleaned. One problem with conventional lint rollers is that some debris is difficult to remove from the surface to be cleaned (i.e. the tape adhesive is not strong enough to separate the debris from the surface.

SUMMARY

The present invention solves the aforementioned problem by providing a debris agitator integral to the lint roller assembly.

The cleaning apparatus includes a handle with a first end and a second end, a cleaning roll support extending from the handle second end and terminating at a distal end, an agitator arm extending from the handle second end parallel to the cleaning roll support and terminating at a distal end and an end cap rotatably connected to the agitator arm distal end. The end cap is configured to be rotatable between an open position away from the cleaning roll support and a closed position in which the end cap engages with the distal end of the cleaning roll support.

Other objects and features of the present invention will become apparent by a review of the specification, claims and appended figures.

BRIEF DESCRIPTION

For a better understanding of the embodiments described in this application, reference should be made to the Detailed Description below, in conjunction with the following drawings in which like reference numerals refer to corresponding parts throughout the figures.

DETAILED DESCRIPTION

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without at least some of these specific details. Moreover, the particular embodiments described herein are provided by way of example and should not be used to limit the scope of the invention to these particular embodiments. In other instances, well-known components have not been described in detail so as not to unnecessarily obscure aspects of the embodiments of the invention.

Figure 1:
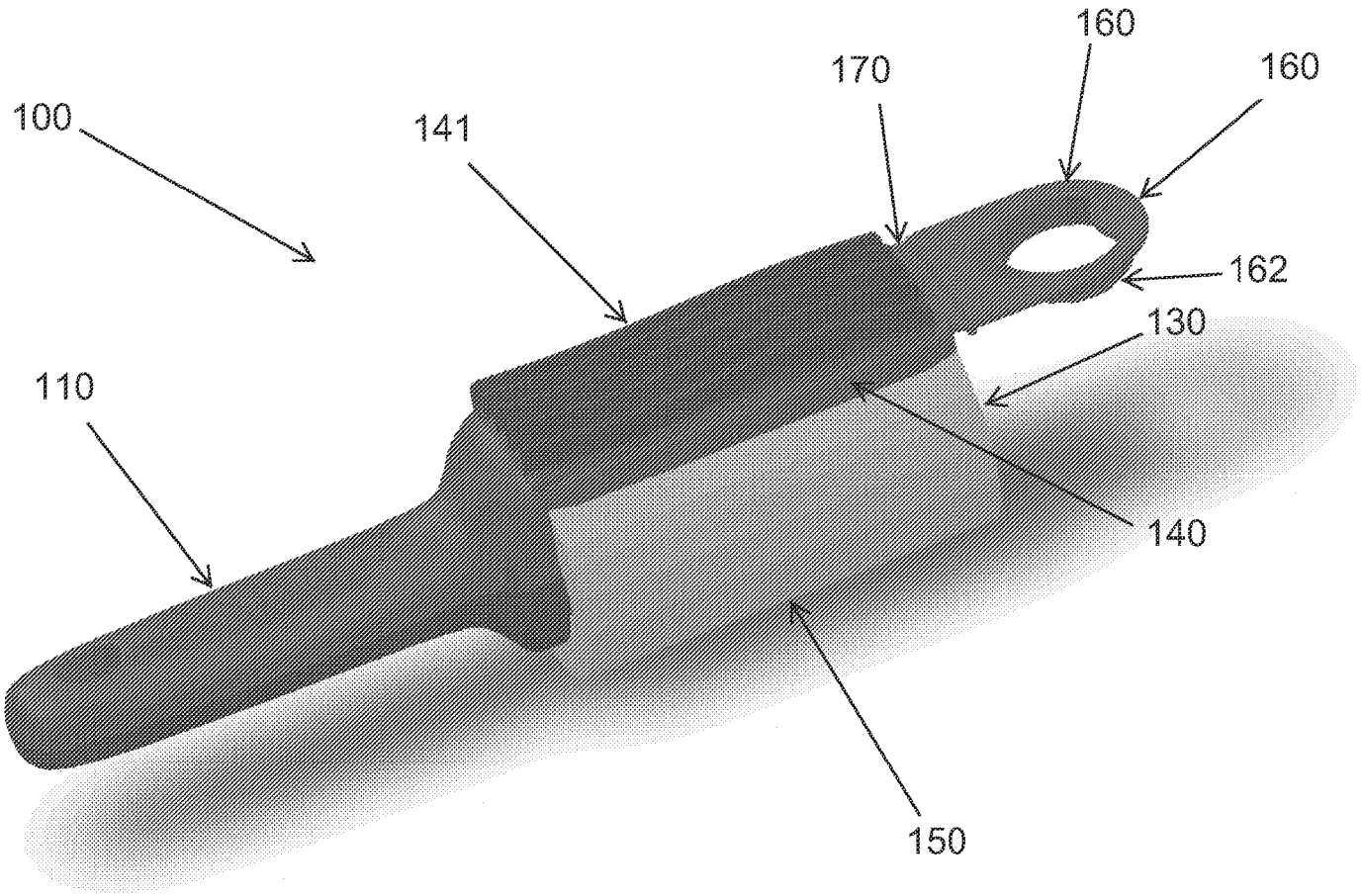
FIG. 1 is an elevated perspective view of a straight handled lint roller.
Figure 2:
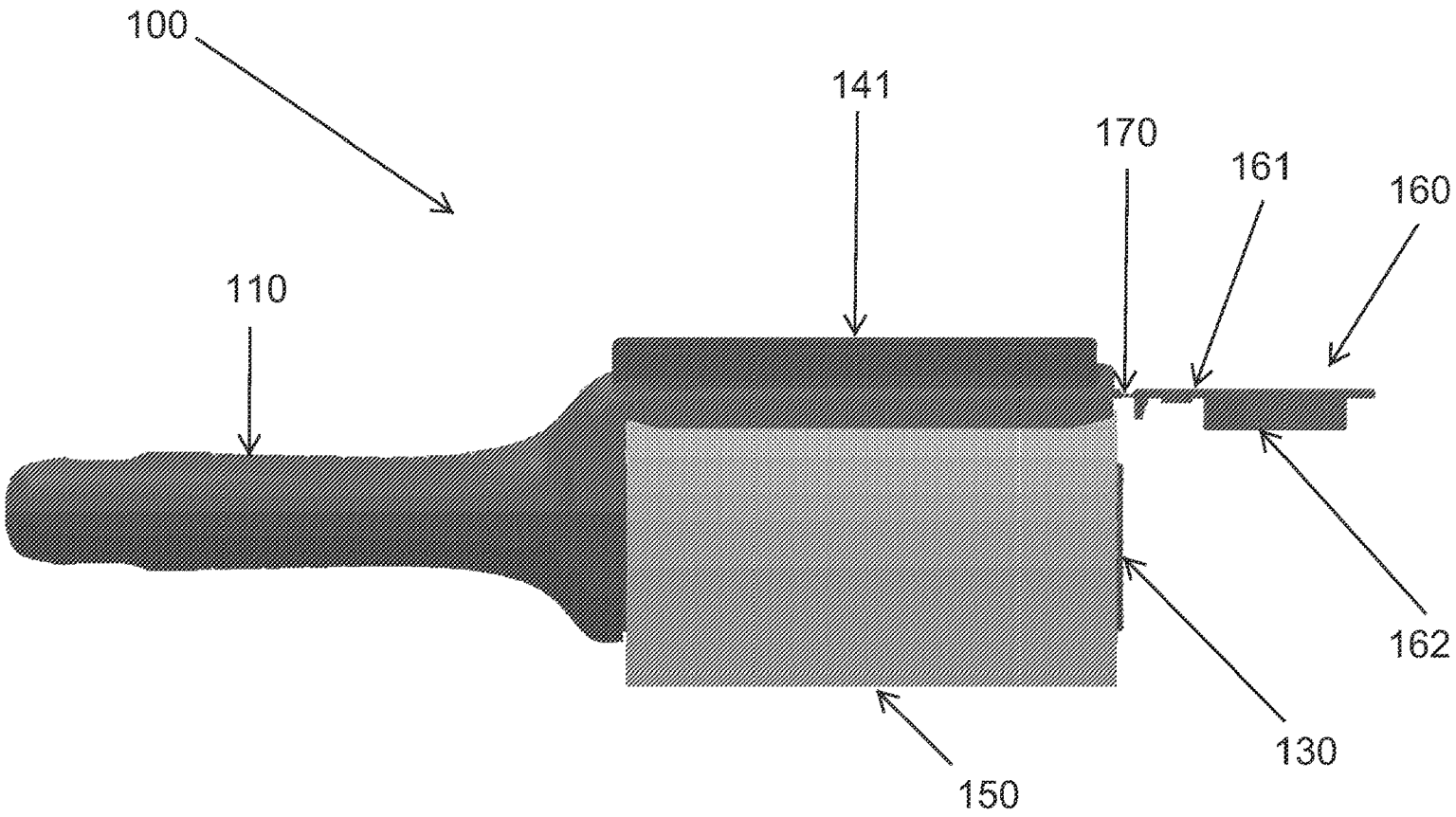
FIG. 2 is a side view of the straight handled lint roller.
Figure 3:
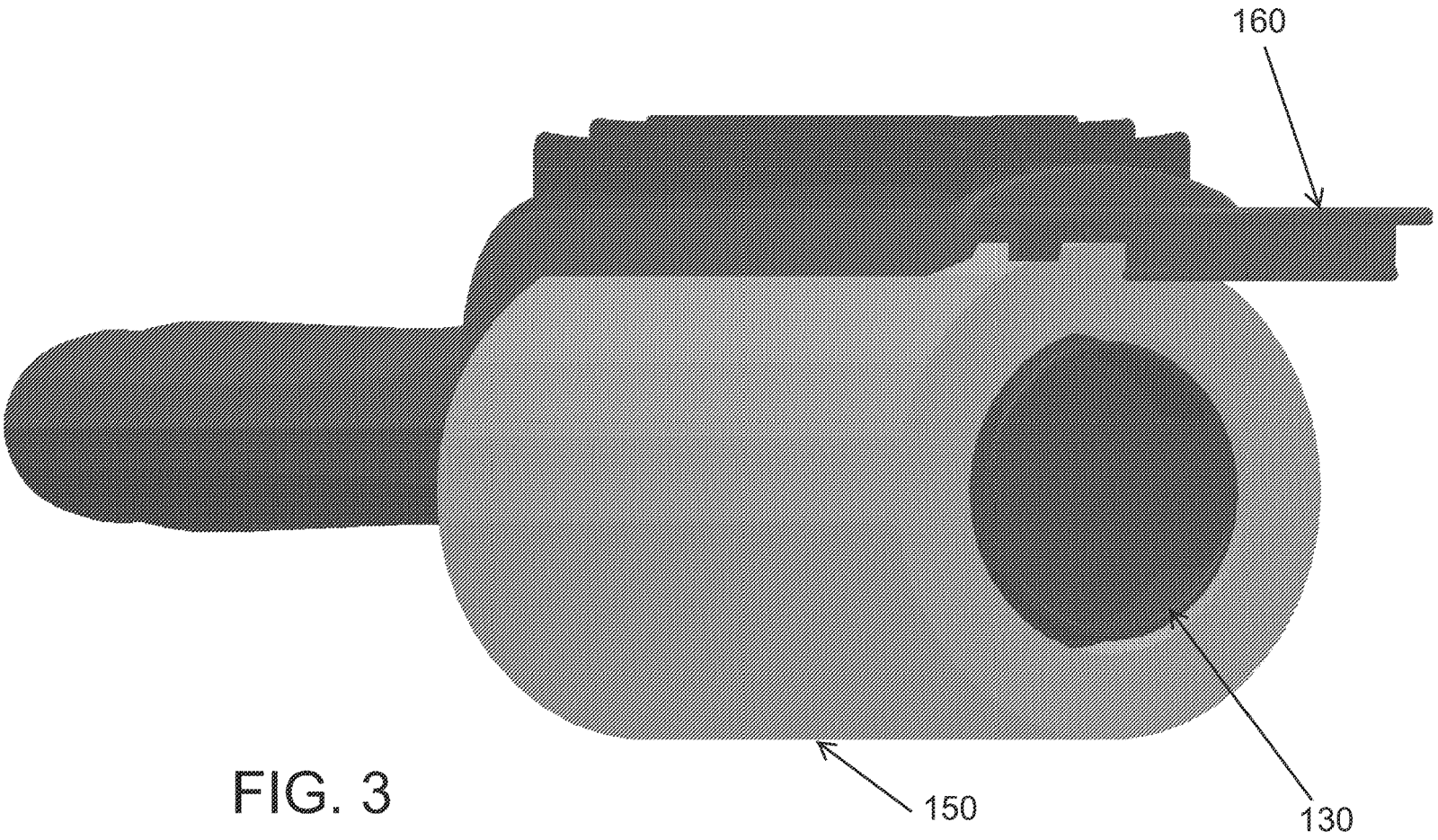
FIG. 3 is a side perspective view of the straight handled lint roller.
Figure 4:
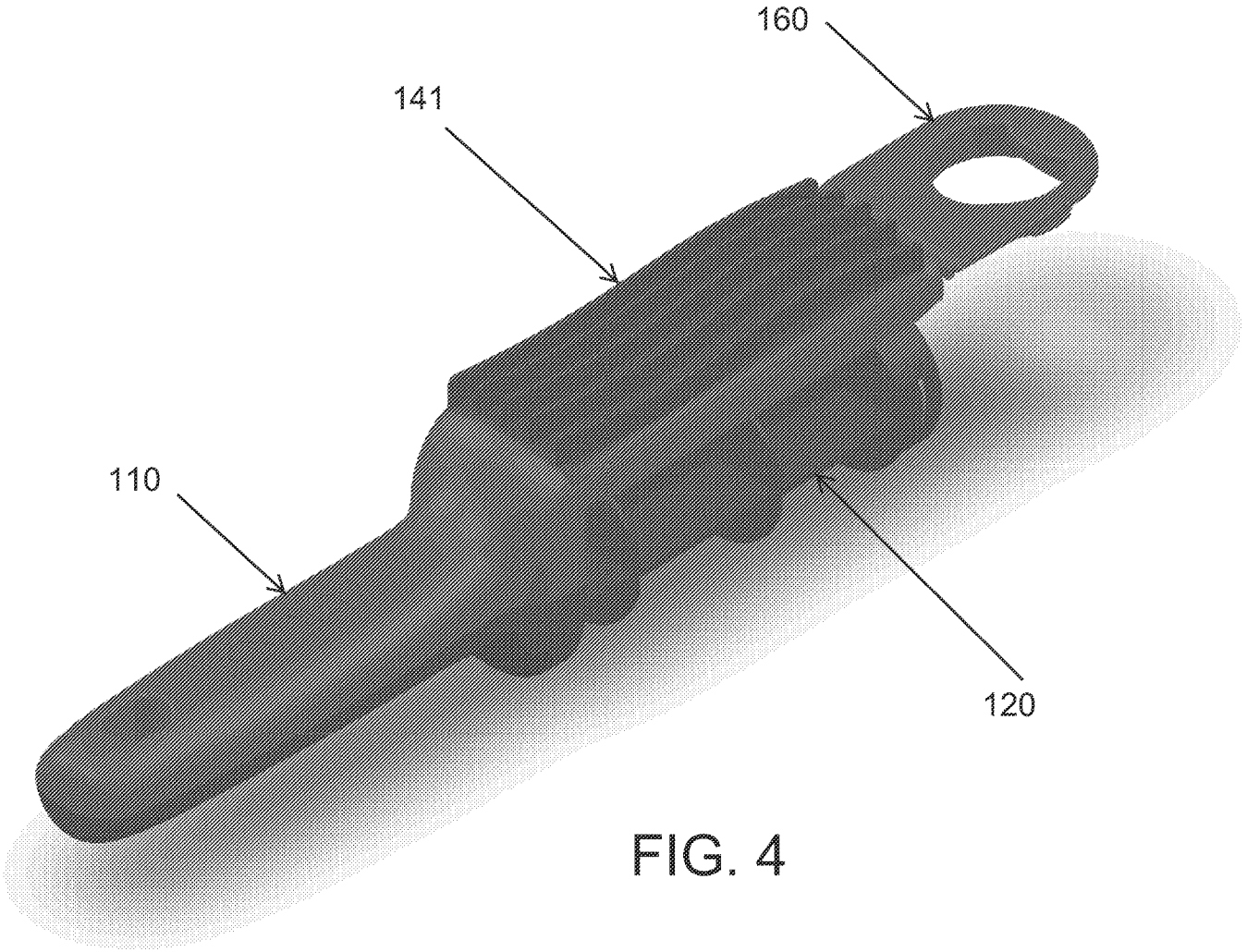
FIG. 4 is an elevated perspective view of the straight handled lint roller with the tape roll removed from the support.
Figure 5:
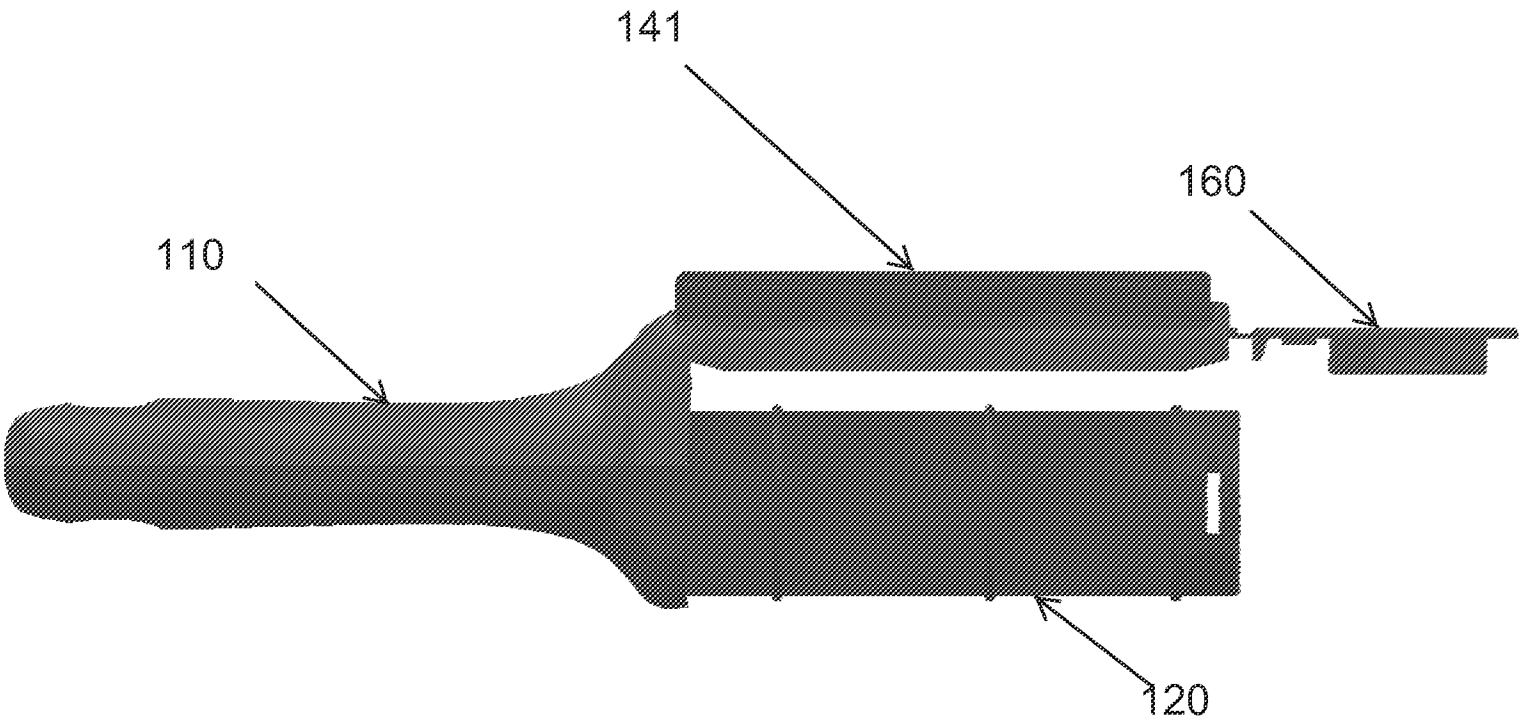
FIG. 5 is a side view of the straight handled lint roller with the tape roll removed from the support.
Figure 6:
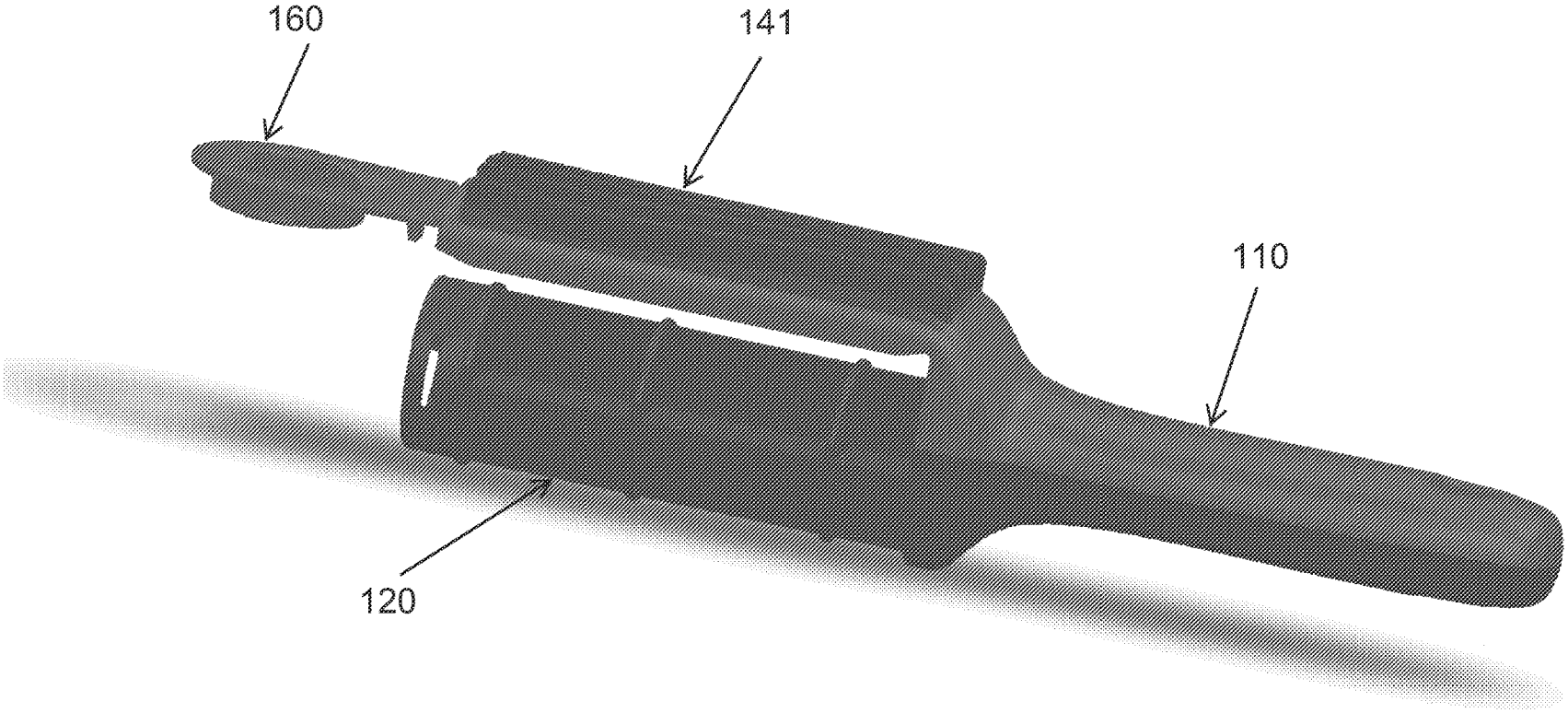
FIG. 6 is a side perspective view of the straight handled lint roller with the tape roll removed from the support.
Figure 7:
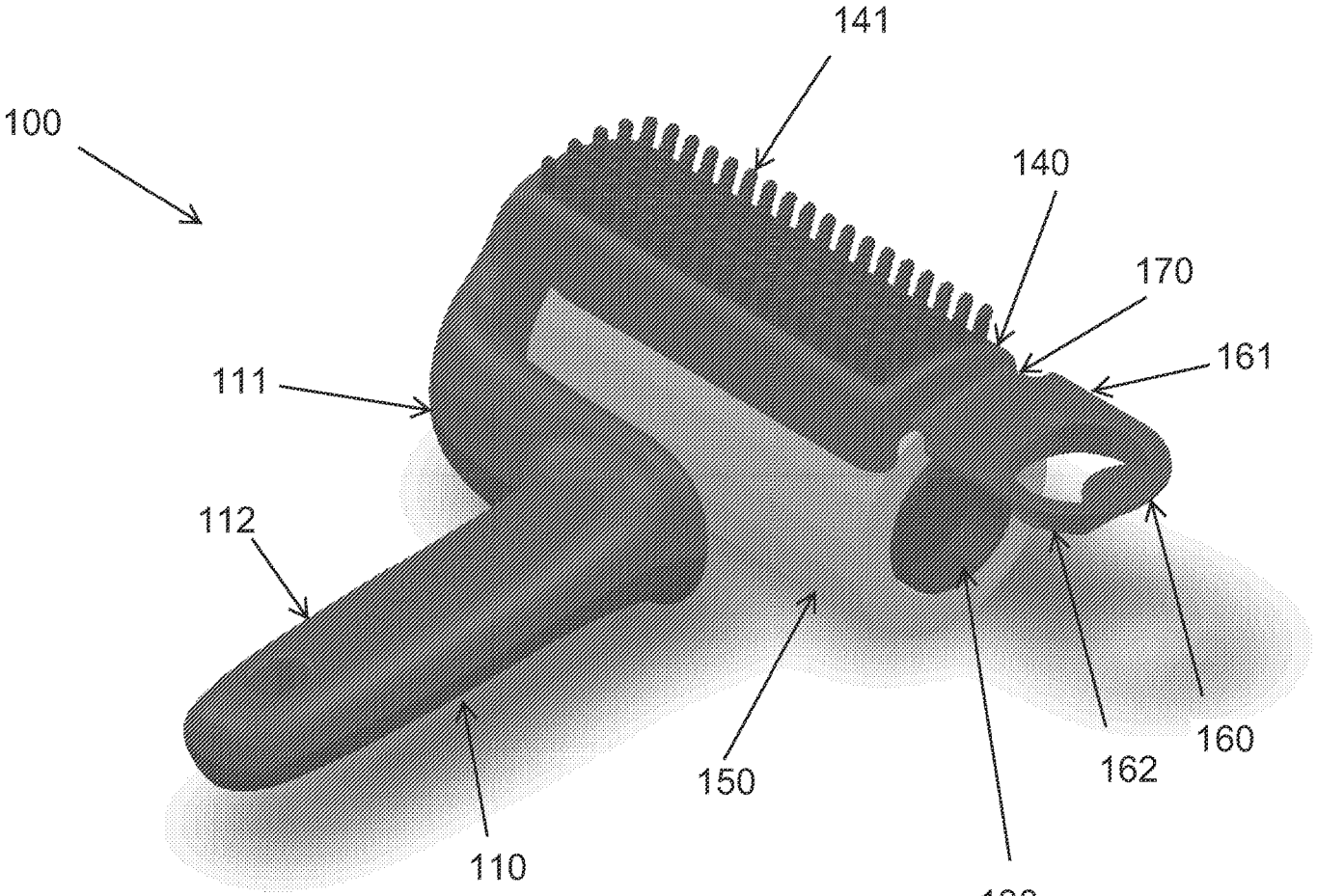
FIG. 7 is an elevated perspective view of a non-straight handled lint roller.
Figure 8:
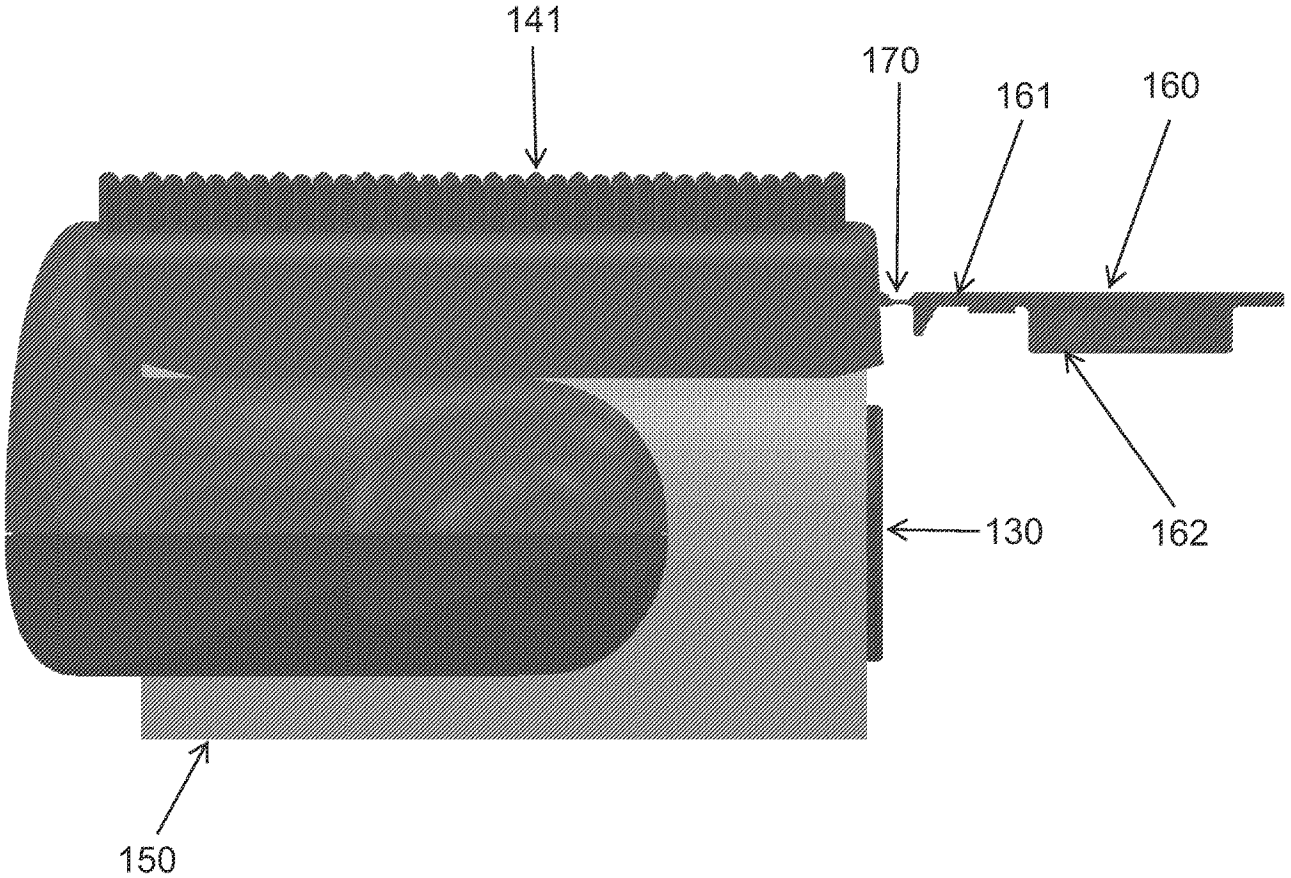
FIG. 8 is a bottom view of the non-straight handled lint roller.
Figure 9:
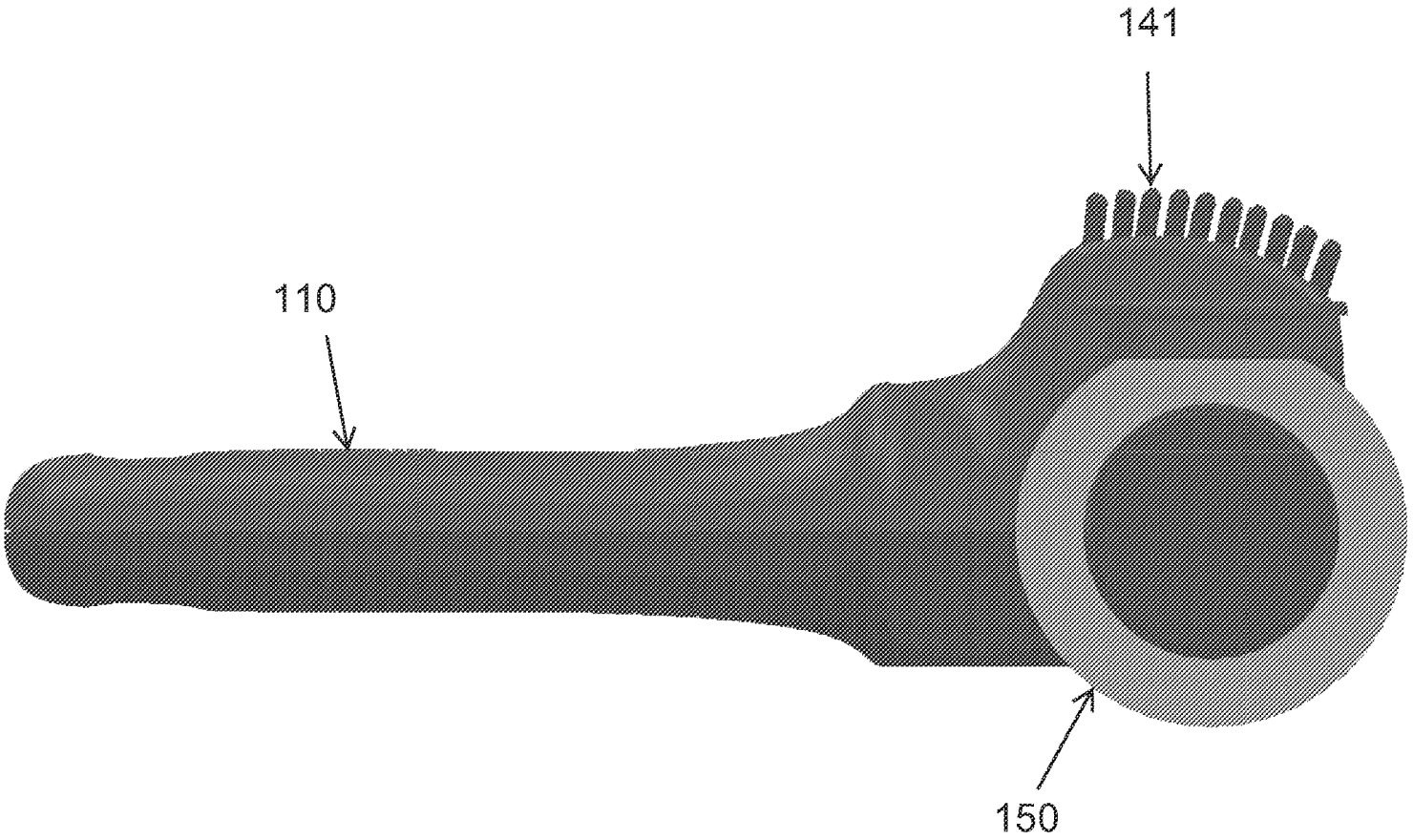
FIG. 9 is a side view of the non-straight handled lint roller.
Figure 10:
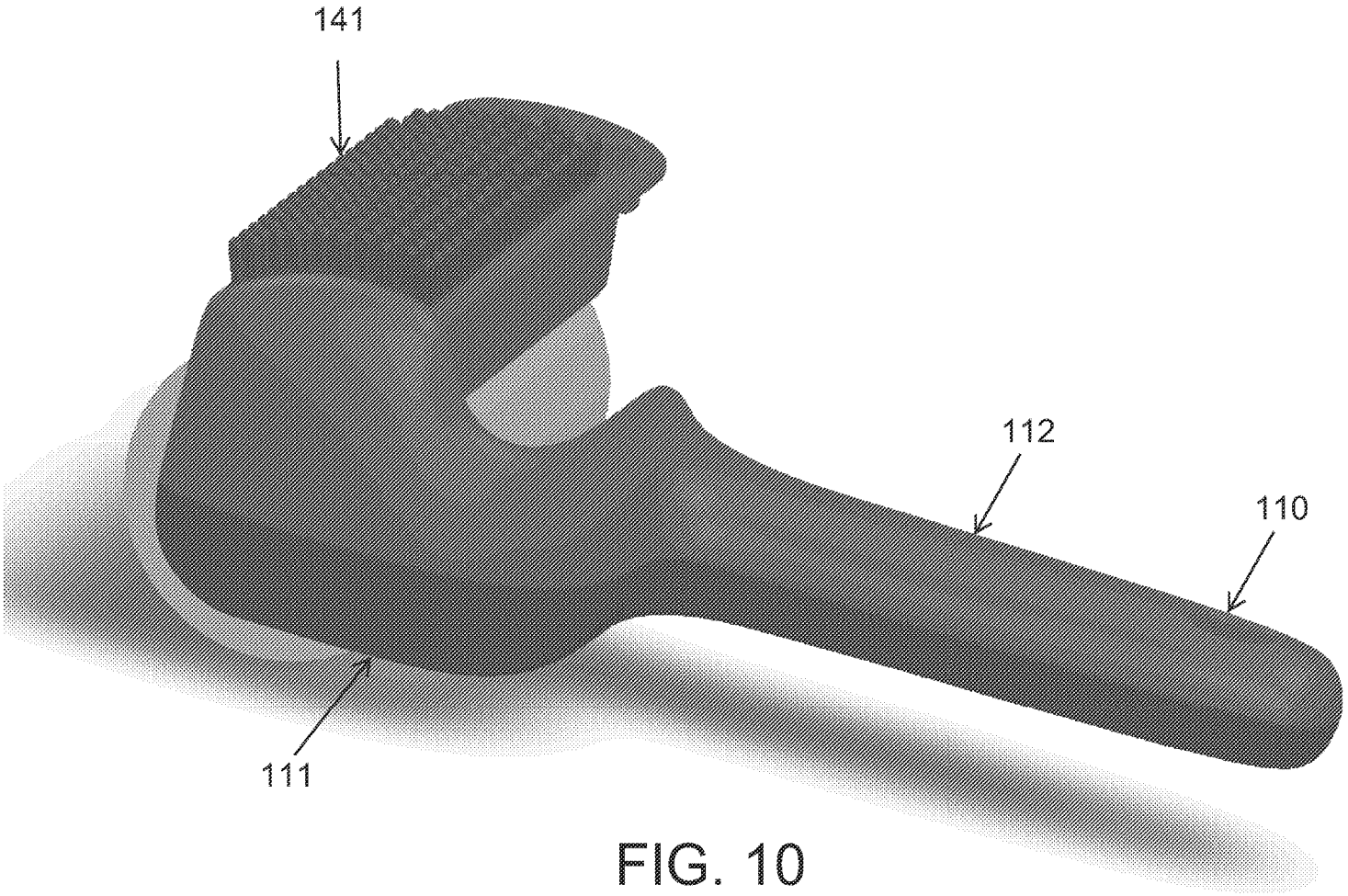
FIG. 10 is an elevated perspective view of the non-straight handled lint roller.

FIGS. 1-6 illustrate a first embodiment (FIGS. 1-3 illustrate the assembly with the tape roll in place, and FIGS. 4-6 illustrate the assembly with the tape roll removed.) Lint roller assembly 100 includes a handle 110, a cleaning roll support 120 extending from the handle 110 that terminates in a circular open end 130, an agitator arm 140 extending from the handle 110, and a cleaning roll 150 (which in the preferred embodiment is a roll of adhesive tape) rotatably mounted on the support 120. The agitator arm 140 extends parallel to but separated from the support 120.

An end cap 160 is rotatably attached or formed to the end of the agitator arm 140 via a hinge 170. Hinge 170 can be any conventional hinge allowing end cap 160 to rotate relative to arm 140. In the embodiment shown, the hinge 170 between the end cap 160 and the end of agitator arm 140 is a living hinge, which is a thin deformable section of material allowing the end cap 160 to rotate relative to arm 140 by flexing the material that forms the hinge. The end cap 160 includes a flat section 161 and an annular shoulder 162 dimensioned to snugly fit into the circular open end 130 of the support 120.

Once the cleaning roll 150 is slid onto the support 120, the end cap 160 can be rotated down until the annular shoulder 162 engages with the open end 130 of the support 120 (i.e. a friction fit) via the living hinge 170. Once engaged in its (closed) position, the end cap 160 serves several purposes, including: 1) preventing the roll of tape 150 from inadvertently sliding off of the support 120 during use, and 2) provide mechanical support for the agitator arm 140 (i.e. to prevent the arm 140 from being deflected or bent during use). The agitator arm 140 includes an agitator 141 made of any material that effectively loosens debris from surfaces. For example, agitator 141 can be ribs (see for example FIGS.

1-6 showing wavy ribs) made of plastic or rubber, or brush bristles (see for example FIGS. 7-12). Other configurations of agitator 141 can include a pad, a series of bumps or bristles, a series of fingers, or any other similar configuration of plastic, rubber or other material that is effective in loosening debris or lint from a surface to be cleaned, so that the cleaning roll is more effective at removing such debris/lint when rolled over the surface being cleaned.

In operation, the user rubs the agitator 141 on the surface to be cleaned, loosening or freeing debris from the surface. The end cap 160 extending between the agitator arm 140 and end of support 120 provides rigid support so that the agitator arm 140 does not deflect or bend when it is pressed hard against the surface being cleaned. After application of the agitator 141, the user rolls the cleaning roll 150 over the surface, where roll 150 rotates around the support 120. In the case of a tape roll for cleaning roll 150, the tape roll 150 has an adhesive surface facing outwardly, where the adhesive collects the loosened debris from the surface. The tape preferably includes many layers, so that when one layer is full of debris, it can be removed thus exposing a fresh layer with adhesive underneath.

FIGS. 1-3 illustrate the lint roller assembly 100 with the roll 150 installed on support 120 and the end cap 160 in its open position. In this position, the roll 150 can be slid onto or removed from support 120. With the tape roll inserted on support 120, once the end cap 160 is rotated down (about hinge 170) until annular shoulder 162 is snuggly inserted into open end 130, the lint roller assembly 100 is ready for use. FIGS. 4-6 illustrate the lint roller assembly 100 without the roll 150 installed on the support 120.

FIGS. 7-12 illustrate a second example embodiment of the lint roller assembly 100. The embodiment of FIGS. 7-12 includes a handle 110 that includes an extension portion 111 extending laterally from a gripping portion 112. The extension portion 111 curves around to the ends of the support 120 and arm 140 such that support 120 and arm 140 extend from the extension portion 111 parallel to each other in a manner where the gripping portion 112 extends perpendicularly to the support 120 and arm 140.

Figure 11:
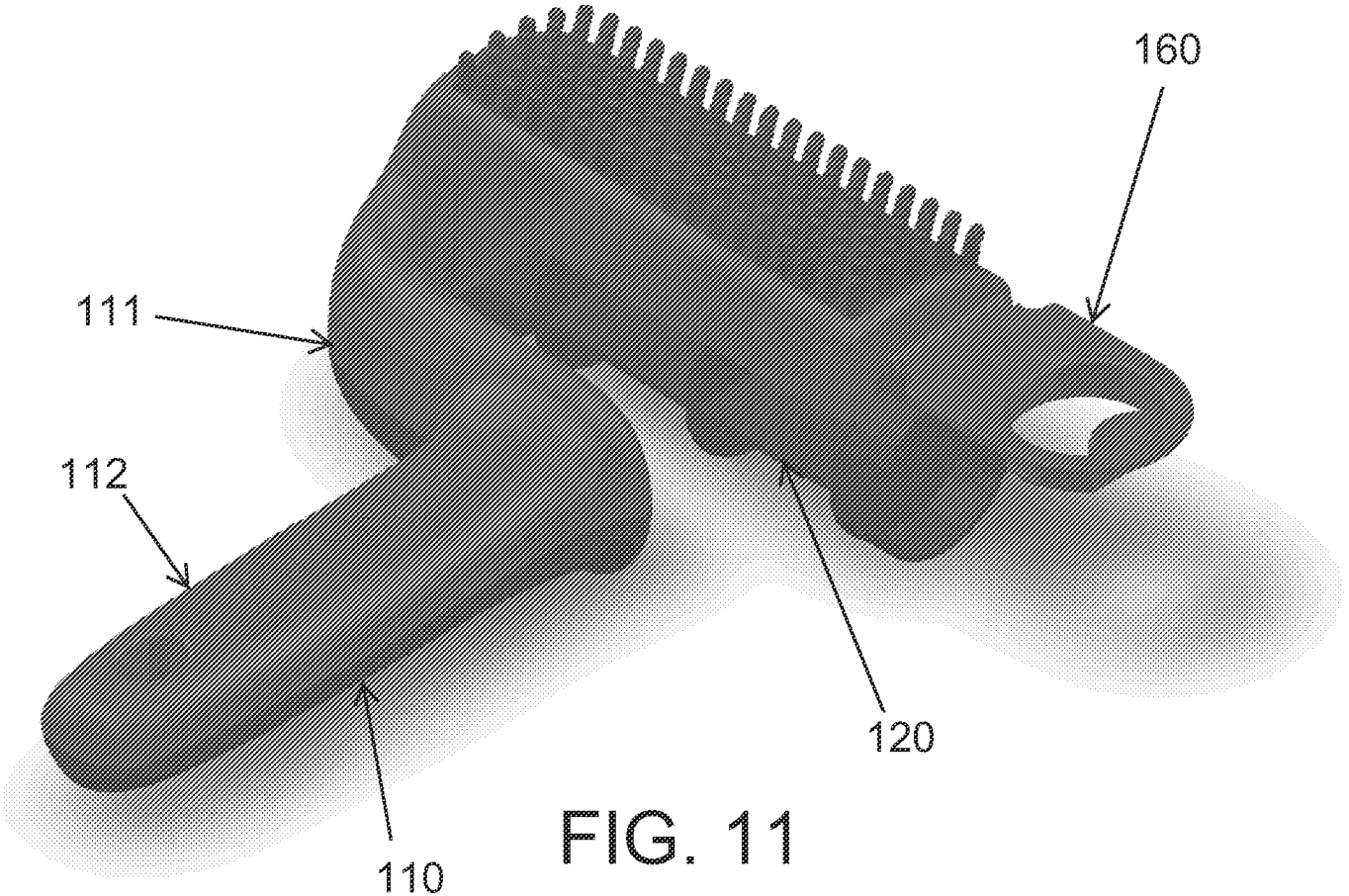
FIG. 11 is an elevated perspective view of the non-straight handled lint roller with the tape roll removed from the support.
Figure 12:
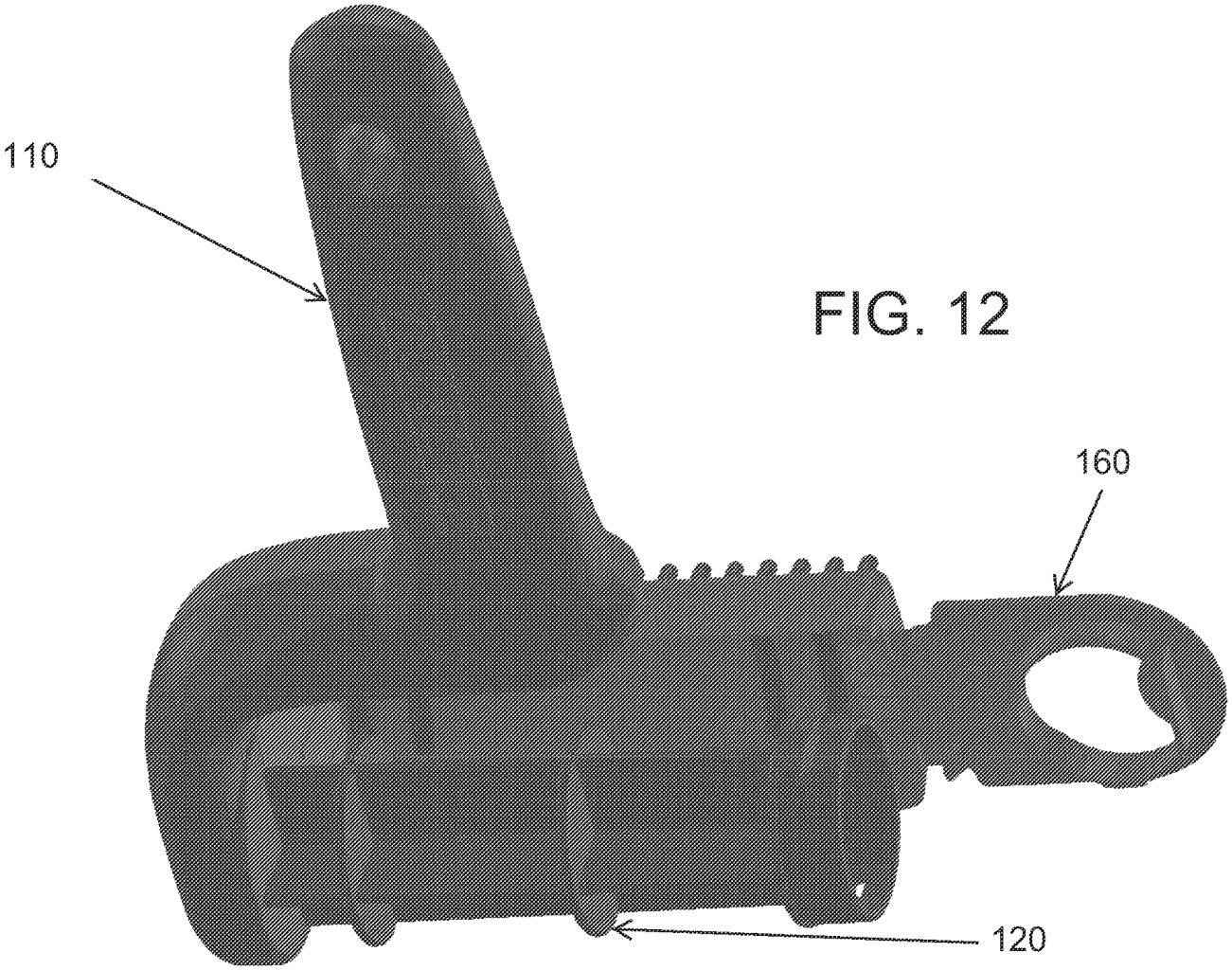
FIG. 12 is a bottom perspective view of the non-straight handled lint roller with the tape roll removed from the support.

FIGS. 7-10 illustrate the second example embodiment with the roll 150 installed, and with bristles for the agitator 141. FIGS. 11-12 illustrate the second example embodiment with the roll 150 removed. With this embodiment, gripping portion 112 of handle 110 extends parallel to the direction in which roll 120 rolls along the surface to be cleaned (which for many applications is preferable for the user).

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. The embodiments described above are disclosed with reference to roll 150 being an adhesive tape roll. However, any debris collecting roll having an outer surface that will collect debris when rolled over the surface to be cleaned can be used. For example, roll 150 need not be made of layers of tape, but rather could instead be a solid or composite substrate with a debris attracting outer surface (e.g. gel, rubber or other sticky and adhesive outer surface) for picking up debris without damaging or leaving a residue on the surface being cleaned. While handles having gripping portions parallel or perpendicular to the rolling direction of roll 120 are shown and described, handles 110 with other shapes could be used.

What is claimed is:

1. A cleaning apparatus, comprising:

a handle with a first end and a second end;

a cleaning roll support extending from the handle second end and terminating at a distal end;

an agitator arm extending from the handle second end parallel to the cleaning roll support and terminating at a distal end;

an end cap rotatably connected to the agitator arm distal end, wherein the end cap is configured to be rotatable between an open position away from the cleaning roll support and a closed position in which the end cap engages with the distal end of the cleaning roll support, wherein when the end cap is engaged with the distal end of the cleaning roll support, the end cap provides support to the agitator arm to substantially prevent deflection or bending of the agitator arm.

2. The cleaning apparatus of claim 1 further comprising an agitator mounted to or formed on the agitator arm.

3. The cleaning apparatus of claim 2 wherein the agitator comprises one or more of a brush, a plurality of longitudinally extending fins, a plurality of bumps a plurality of fingers, and a pad.

4. The cleaning apparatus of claim 1 wherein the handle is straight.

5. The cleaning apparatus of claim 1 wherein the handle comprises first and second portions that are non-linear with respect to each other, and wherein the cleaning roll support and agitator arm extend from the handle second portion.

6. The cleaning apparatus of claim 5 wherein the handle first portion extends perpendicular to the cleaning roll support and the agitator arm.

7. The cleaning apparatus of claim 1, further comprising a cleaning roll rotatably mounted on the cleaning roll support and having a debris attracting outer surface.

8. The cleaning apparatus of claim 7 wherein the cleaning roll comprises one or more of adhesive paper tape, adhesive plastic tape, gel, rubber, and plastic.

9. The cleaning apparatus of claim 1 wherein the end cap is rotatably connected to the agitator arm by a living hinge of flexible material.

10. The cleaning apparatus of claim 1 wherein the cleaning roll support is tube-shaped.

11. The cleaning apparatus of claim 1 wherein the distal end of the cleaning roll support defines a circular open end, and wherein the end cap comprises an annular shoulder that engages with the open end by a friction fit.

* * * * *